US010458398B2

(12) United States Patent
Jeong

(10) Patent No.: US 10,458,398 B2
(45) Date of Patent: Oct. 29, 2019

(54) METHOD OF SETTING ZERO POINT OF BI-DIRECTIONAL LINEAR PUMP FOR ACTIVE SUSPENSION APPARATUS

(71) Applicant: MANDO CORPORATION, Pyeongtaek-si, Gyeonggi-do (KR)

(72) Inventor: Seung Hwan Jeong, Yongin-si (KR)

(73) Assignee: MANDO CORPORATION, Pyeongtaek-si, Gyeonggi-do (KR)

( * ) Notice: Subject to any disclaimer, the term of this patent is extended or adjusted under 35 U.S.C. 154(b) by 170 days.

(21) Appl. No.: 15/204,698

(22) Filed: Jul. 7, 2016

(65) Prior Publication Data

US 2017/0009764 A1 Jan. 12, 2017

(30) Foreign Application Priority Data

Jul. 8, 2015 (KR) ..... 10-2015-0097281

(51) Int. Cl.

| | |
|---|---|
| ***F04B 51/00*** | (2006.01) |
| ***F04B 9/04*** | (2006.01) |
| ***F04B 49/06*** | (2006.01) |
| ***F04B 49/10*** | (2006.01) |

(52) U.S. Cl.

CPC ..... *F04B 9/047* (2013.01); *F04B 49/065* (2013.01); *F04B 49/106* (2013.01); *F04B 2201/0201* (2013.01)

(58) Field of Classification Search

CPC ..... F04B 51/00

USPC ..... 73/1.79, 168; 417/63; 702/33–56, 100, 702/104; 280/5.5–5.524, 678

See application file for complete search history.

(56) References Cited

U.S. PATENT DOCUMENTS 6,000,702 A 12/1999 Streiter

*Primary Examiner* — Robert R Raevis

(74) *Attorney, Agent, or Firm* — Morgan, Lewis & Bockius LLP

(57) ABSTRACT

A method of setting a zero point according to one embodiment of the present disclosure relates to a method of setting a zero point of a bi-directional linear pump for an active suspension apparatus supplying fluid to an actuator connected to a coil spring coupled to a wheel of a vehicle, which includes controlling at least one of a first valve disposed between the actuator and the pump and a second valve disposed between the pump and a fluid reservoir by means of an electronic control unit (ECU) in a first Operation, moving a piston disposed inside the pump to one side to move the piston up to a MAX Stroke position of the one side in a second Operation, calculating an approximate MIN Stroke position of the other side of the piston based on the MAX Stroke position of the one end thereof in a third Operation, moving the piston to the other side to move the piston up to a MIN Stroke position in a fourth Operation, comparing the approximate MIN Stroke position of the other side with the MIN Stroke position thereof in a fifth Operation, and determining whether or not the pump is normal in a sixth Operation based on the comparison result.

9 Claims, 6 Drawing Sheets

METHOD OF SETTING ZERO POINT OF BI-DIRECTIONAL LINEAR PUMP FOR ACTIVE SUSPENSION APPARATUS

CROSS-REFERENCE TO RELATED APPLICATION

This application claims priority to and the benefit of Korean Patent Application No. 10-2015-0097281, filed on Jul. 8, 2015, the disclosure of which is incorporated herein by reference in its entirety.

BACKGROUND

1. Field of the Invention

The present disclosure relates to a method of setting a zero point of a bi-directional linear pump, and more particularly, to a method of setting a zero point of a bi-directional linear pump in an active suspension apparatus for vehicles, which supplies fluid to an actuator assigned to a wheel of a vehicle.

2. Discussion of Related Art

An active suspension system in a vehicle refers to a system which senses various inputs collected from a road through sensors and enables an electric control unit (ECU) to effectively control rolling behavior of the vehicle based on the sensed various inputs.

In particular, the active suspension system may be provided with an actuator compensating a displacement of a coil spring connected to a wheel of a vehicle and may properly control an amount of fluid supplied to the actuator and sense variations of rolling and pitching of the vehicle to constantly maintain a vehicle height above ground, thereby performing a function capable of improving ride comfort of the vehicle and a tire grip force thereof.

In addition, the active suspension system may enable a driver to set a vehicle height above ground according to a road condition through a level control of the vehicle height, or may lower a vehicle height above ground at a high speed to reduce air resistance, thereby performing a function capable of improving a driving stability and fuel efficiency.

In terms of such an active suspension system, U.S. Pat. No. 6,000,702 discloses technical contents in which a spring and a lift-adjustable regulating unit connected thereto in series are included and an amount of fluid supplied to the lift-adjustable regulating unit is adjusted through a proportional control valve.

However, such technical contents have problems in that a high-priced proportional control valve and a high-priced hydraulic pump should be used, and also the hydraulic pump is connected to an engine and is constantly driven due to a structural reason to generate a high pressure source through a constant driving of the hydraulic pump while the engine is running, so that excess capacity not required for the active suspension system is additionally needed and an engine output is reduced, thereby exerting a bad influence to the fuel efficiency.

Moreover, in the patent literature, a bi-directional linear pump may be employed as a pump supplying fluid to such an active suspension system, but a technical feature for locating a piston inside the bi-direction linear pump at a neutral position after supplying the fluid to one side of the active suspension system is not disclosed so that there is a problem in that an effective response against a control input may be very difficult.

PRIOR ART LITERATURE

Patent Literature

U.S. Pat. No. 6,000,702

SUMMARY OF THE INVENTION

Therefore, to address the problems described above, a method of setting a zero point of a bi-directional linear pump according to one embodiment of the present disclosure has the following object.

An object of the present disclosure is to provide a method of setting a zero point of a bi-directional linear pump capable of effectively managing a control input by setting a zero point of a bi-directional linear pump based on MAX and MIN Stroke positions of a piston and also detecting a fail state while setting the zero point when a disturbance generated by a motor, a gear, a valve and the like occurs.

The problems to be solved by the present disclosure are not limited to the described above, and other problems not mentioned above will be clearly appreciated by those skilled in the art from the following description.

A method of setting a zero point of a bi-directional linear pump according to one embodiment of the present disclosure relates to a method of setting a zero point of a bi-directional linear pump for an active suspension apparatus supplying fluid to an actuator connected to a coil spring coupled to a wheel of a vehicle, which includes controlling in a first Operation at least one of a first valve disposed between the actuator and the pump and a second valve disposed between the pump and a fluid reservoir by means of an electronic control unit (ECU), moving in a second Operation a piston disposed inside the pump toward one side to move the piston to a MAX Stroke position of the one side, calculating in a third Operation an approximate MIN Stroke position of the other side of the piston based on the MAX Stroke position of the one side thereof, moving in a fourth Operation the piston toward the other side to move the piston to a MIN Stroke position, comparing in a fifth Operation the approximate MIN Stroke position of the other side with the MIN Stroke position thereof, and determining in a sixth Operation whether or not the pump is normal based on the comparison result.

The first Operation may be preferable to enable the ECU to control the first valve to block a flow of the fluid between the actuator and the pump, and to control the second valve to allow a flow of the fluid between the pump and the fluid reservoir.

The second Operation may be preferable to include applying in a 2-1 Operation a preset electric power to a motor at a predetermined period to gradationally move the piston in a direction of the one side, detecting in a 2-2 Operation a position of the motor, which rotated for the predetermined period, and determining in a 2-3 Operation whether or not the piston is arrived at the MAX Stroke position of the one side based on the position of the motor.

The 2-3 Operation may be preferable to include detecting in a 2-3a Operation a first position of the motor, which rotated for a current period, and a second position thereof, which rotated for a previous period, to compare a difference between the first position and the second position with a preset value, and determining in a 2-3b Operation that a rotation of the motor stops when the difference between the first position and the second position is less than the preset value.

The 2-3 Operation may be preferable to further include applying in a 2-3c Operation additionally the preset electric power to the motor at a regular period after the 2-3b Operation, comparing in a 2-3d Operation a number of times the preset electric power is additionally applied with a predetermined number of times, and determining in a 2-3e Operation that the piston is arrived at the MAX Stroke position of the one side when the number of times the preset electric power is additionally applied is equal to or greater than the predetermined number of times as the comparison result of the 2-3d Operation.

In the third Operation, the approximate MIN Stroke position of the other side of the piston may be preferable to be calculated based on a length of a chamber accommodating the piston.

The fourth Operation may be preferable to include applying in a 4-1 Operation the preset electric power to the motor at a predetermined period to gradationally move the piston in a direction of the other side, detecting in a 4-2 Operation a position of the motor, which rotated for the predetermined period, and determining in a 4-3 Operation whether or not the piston is arrived at the MIN Stroke position of the other side based on the position of the motor.

The 4-3 Operation may be preferable to include detecting in a 4-3a Operation a third position of the motor, which rotated for a current period, and a fourth position thereof, which rotated for a previous period, to compare a difference between the third position and the fourth position with a preset value, and determining in a 4-3b Operation that a rotation of the motor stops when the difference between the third position and the fourth position is less than the preset value.

The 4-3 Operation may be preferable to further include applying in a 4-3c Operation additionally the preset electric power to the motor at a regular period after the 4-3b Operation, comparing in a 4-3d Operation a number of times the preset electrical power is additionally applied with a predetermined number of times, and determining in a 4-3e Operation that the piston is arrived at the MIN Stroke position of the other side when the number of times the preset electrical power is additionally applied is equal to or greater than the predetermined number of times as the comparison result of the 4-3d Operation.

The fifth Operation may be preferable to compare a difference between the approximate MIN Stroke position of the other side of the piston and the MIN Stroke position thereof with a preset value E.

The sixth Operation may be preferable to determine that the pump is normal when the difference between the approximate MIN Stroke position of the other side of the piston and the MIN Stroke position thereof is less than the preset value E.

When the pump is determined to be normal in the sixth Operation, calculating at least one of a neutral position of the piston and a target position of the motor corresponding to the neutral position of the piston based on at least one of the MAX Stroke position of the one side of the piston and the MIN Stroke position of the other side thereof may be preferable.

When the pump is determined to be normal in the sixth Operation, driving the motor in the direction of the one side to move the piston to the neutral position may be preferable to be further included in a seventh Operation.

The seventh Operation may be preferable to include applying in a 7-1 Operation the preset electric power to the motor at a regular period to gradationally move the piston, comparing in a 7-2 Operation a position of the motor with the target position thereof, and stopping in a 7-3 Operation the applying of the preset electric power when a difference between the position of the motor and the target position thereof is less than a preset value.

The method of setting a zero point of the bi-directional linear pump for the active suspension apparatus according to one embodiment of the present invention may provide effectiveness capable of effectively controlling the active suspension apparatus for vehicles by setting a zero point of the bi-directional linear pump in consideration of all of the MAX Stroke position of one side of the piston included in the bi-directional linear pump and the MIN Stroke position of the other side thereof, and also actively detecting a fail state while setting the zero point when a disturbance occurs.

The effectiveness of the present disclosure is not limited to the described above, and other effectiveness not mentioned above will be clearly appreciated by those skilled in the art from the following description.

BRIEF DESCRIPTION OF THE DRAWINGS

The above and other objects, features and advantages of the present disclosure will become more apparent to those skilled in the art by describing in detail exemplary embodiments thereof with reference to the accompanying drawings, in which.

DETAILED DESCRIPTION OF EXEMPLARY EMBODIMENTS

Figure 1:
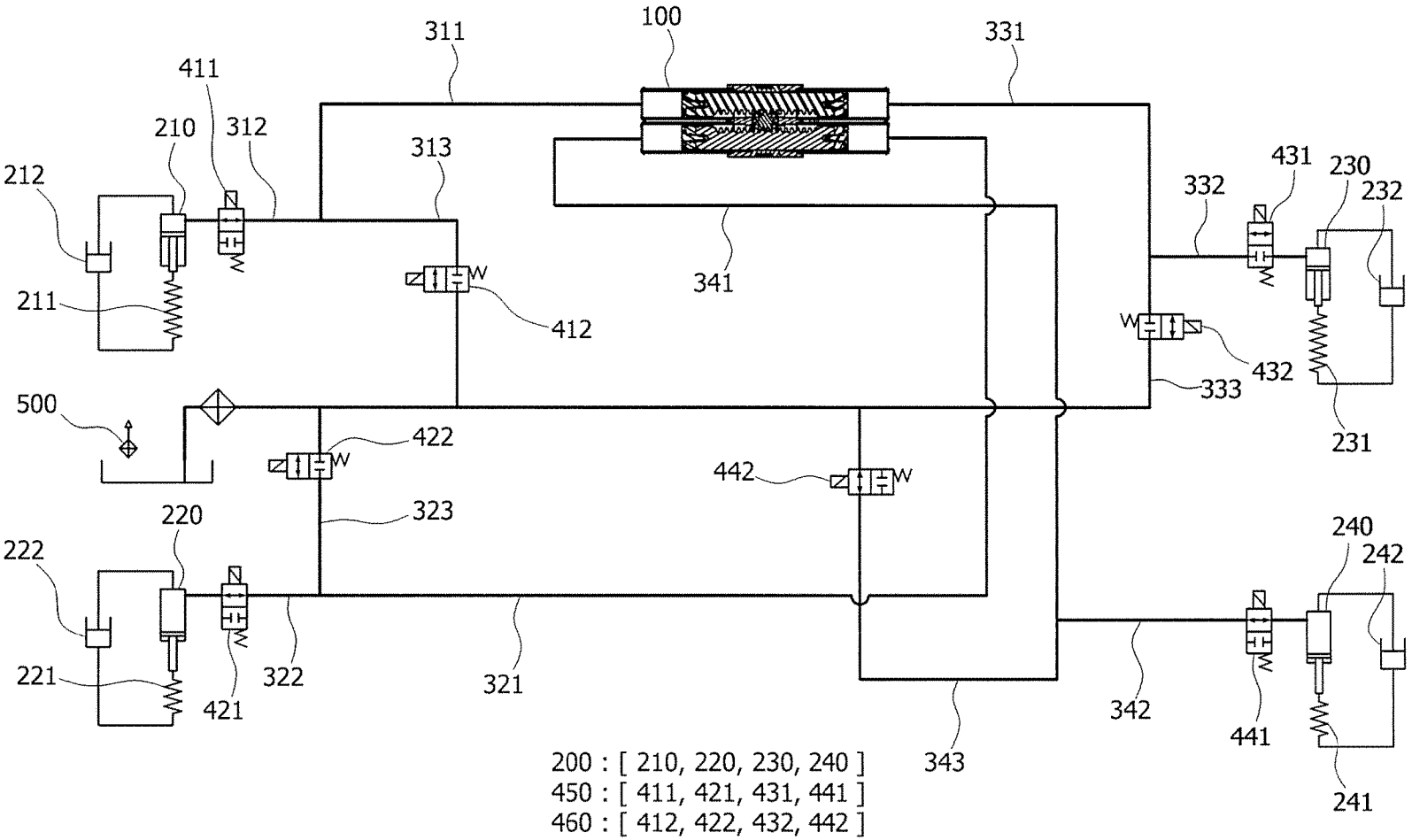
FIG. 1 is a circuit diagram illustrating one example of an active suspension apparatus for vehicles to which a method of setting a zero point of a bi-directional linear pump according to one embodiment of the present disclosure is applied.

Preferred embodiments according to the present disclosure will be described in detail with reference to the accompanying drawings, and the same reference numerals are given to the same or similar components regardless of reference numerals and a repetitive description thereof will be omitted.

Also, in the following description of the present disclosure, if a detailed description of known arts is determined to obscure the interpretation of embodiments of the present disclosure, the detailed description thereof will be omitted. Moreover, it should be noted that the accompanying drawings are not to be taken in a sense for limiting the spirit of the present disclosure but for easy explanation thereof.

Hereinafter, prior to describing a method of setting a zero point of a bi-directional linear pump for an active suspension apparatus according to one embodiment of the present disclosure, an active suspension apparatus for vehicles will be described with reference to FIGS. 1 to 3. FIG. 1 is a circuit diagram illustrating one example of an active suspension apparatus for vehicles to which a method of setting a zero point of a bi-directional linear pump according to one embodiment of the present disclosure is applied, and FIGS.

2 and 3 are diagrams illustrating one example of the bi-directional linear pump according to one embodiment of the present disclosure.

As shown in FIG. 1, an active suspension apparatus for vehicles according to one embodiment of the present disclosure may generally include a pump 100, an actuator 200, a path, valves 450 and 460, and a fluid reservoir 500.

The pump 100 is a configuration for generating a hydraulic pressure in fluid which is used in the active suspension apparatus for vehicles, and serves to adjust movement of the fluid inside that apparatus, and more particularly, to be driven using a motor 110. Typically, a pump of an active suspension apparatus for vehicles is a hydraulic pump and is connected to an engine to be driven constantly so that there is a problem in that an unnecessary pressure is generated. On the other hand, when a structure in which the pump 100 is driven by the motor 110 is employed as in the active suspension apparatus for vehicles according to one embodiment of the present disclosure, an electronic control unit (ECU) may transmit a signal to the motor 110 as necessary to selectively drive the pump 100 so that it may anticipate effectiveness of an engine output saving and a fuel efficiency improvement.

As shown in FIG. 1, the actuator 200 may receive the fluid supplied from the pump 100, and may be classified into first, second, third, and fourth actuators 210, 220, 230, and 240 assigned to a left front wheel, a left rear wheel, a right front wheel, and a right rear wheel of a vehicle, respectively. The actuators 210, 220, 230, and 240 are connected to coil springs 211, 221, 231, and 241 and dampers 212, 222, 232, and 242, respectively, and in particular, they serve to compensate displacements of the coil springs 211, 221, 231, and 241.

In particular, the pump 100 may be configured to simultaneously supply the fluid to the first actuator 210 and the second actuator 220, or to the third actuator 230 and the fourth actuator 240 on the basis of a driving of the motor 110. In other words, as shown in FIG. 1, through a driving of the single pump 100, it is possible to simultaneously supply fluid to actuators assigned to front and rear sides of left wheels of a vehicle, or to actuators assigned to front and rear sides of right wheels thereof.

The path is a passage for movement of the fluid between the pump 100, and the actuator 200 or the fluid reservoir 500. As shown in FIG. 1, a path formed between the pump 100 and the first actuator 210 may be classified into a 1-1 path 311 directly connected to the pump 100, and a 1-2 path 312 and a 1-3 path 313 which are branched off from the 1-1 path 311, wherein the 1-2 path 312 is a path connected to the first actuator 210 and the 1-3 path 313 is a path connected to the fluid reservoir 500. Each of paths connected from the pump 100 to the second actuator 220, the third actuator 230, and the fourth actuator 240 may also be classified the same as the path formed between the pump 100 and the first actuator 210 shown in FIG. 1, and a description thereof will be omitted.

A valve is arranged at the path to serve to control a flow of the fluid. Specifically, in the active suspension apparatus for vehicles according to one embodiment of the present disclosure, an ON/OFF valve is employed instead of a proportional control valve and an operation of such an ON/OFF valve is controlled through an electronic control unit so that movement of the fluid may be selectively controlled. Through such an operation, effectiveness in that a system structure is simplified and a cost is reduced may be anticipated.

Meanwhile, when a flow rate of the fluid inside the active suspension apparatus for vehicles according to one embodiment of the present invention is excessive, the fluid reservoir 500 serves to accommodate and store the excess fluid, and otherwise, when the actuators 200 need a supplying of a more flow rate of the fluid, it serves to supply the fluid to each of the actuators 200 or the pump 100.

Figure 2:
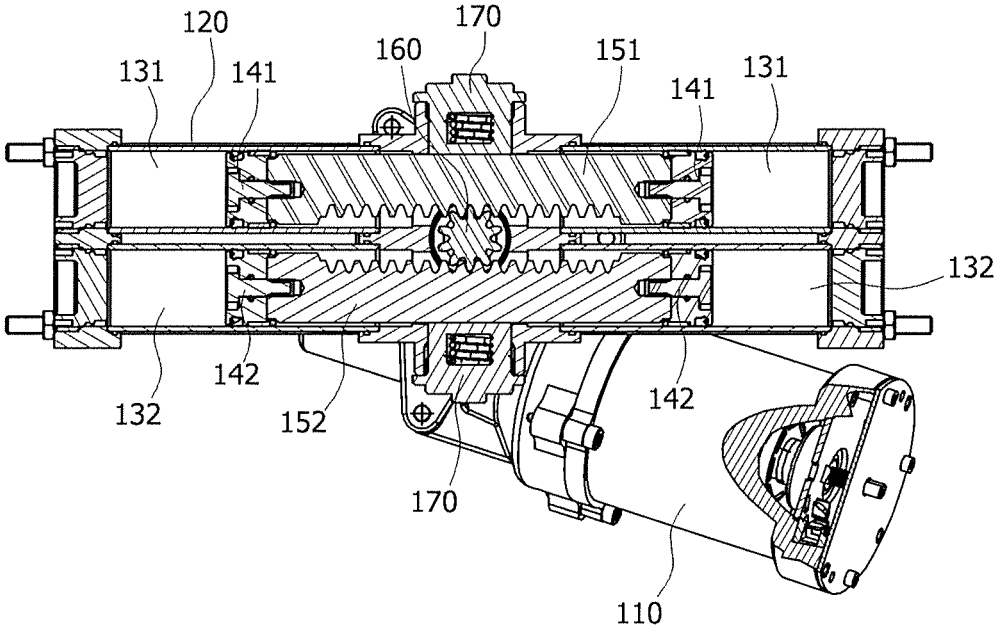
FIGS. 2 and 3 are diagrams illustrating one example of the bi-directional linear pump according to one embodiment of the present disclosure.
Figure 3:
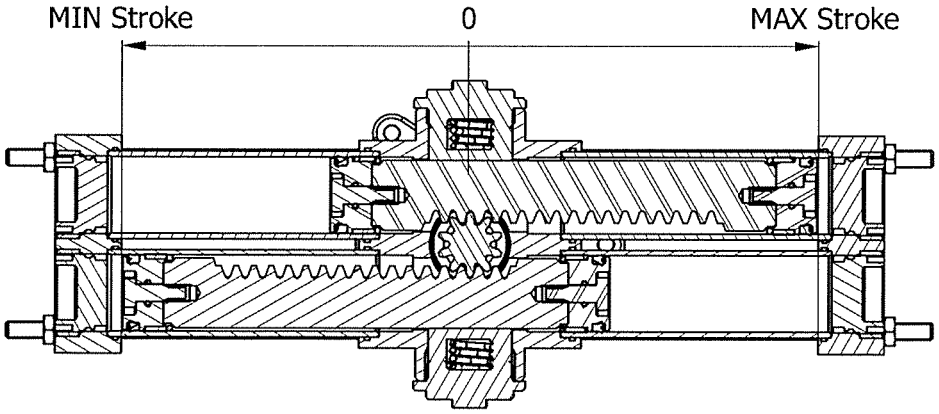

In particular, the pump 100 may be provided with a single chamber and a single piston, and also, as shown in FIGS. 2 and 3, it may be provided with two cylinders and two pistons so that a pump of a dual cylinder structure capable of controlling the plurality of actuators 200 may be employed without increasing a motor output. Hereinafter, the present disclosure will be described based on a pump of a dual cylinder structure.

As shown in FIGS. 2 and 3, in the bi-directional linear pump according to one embodiment of the present invention, a first rack bar 151 and a second rack bar 152, on each of which a groove of a sawtooth shape is formed at one side, support a first piston 141 and a second piston 142, respectively, and a pinion 160 is disposed to be engaged with the groove formed at one side of each of the first rack bar 151 and the second rack bar 152. The pinion 160 is connected to the motor 110, and when the pinion 160 is rotated by the motor 110, the first rack bar 151 and the second rack bar 152 are moved in opposite directions to each other as shown in FIG. 3. In conclusion, the first piston 141 and the second piston 142 are moved in opposite directions to each other by the movement of the first rack bar 151 and the second rack bar 152.

With such a dual cylinder pump structure, the single pump 100 may simultaneously supply the fluid to the plurality of actuators 200. Generally, to control a plurality of actuators by a single pump, capacity of the single pump should be increased and there is difficulty in increasing the capacity of the single pump due to a limitation to a motor output. On the other hand, in the pump 100 of the dual cylinder structure applied to the active suspension apparatus for vehicles according to one embodiment of the present disclosure, there is an advantage capable of controlling the plurality of actuators 200 without increasing a motor output.

Meanwhile, the pump 100 of the active suspension apparatus for vehicles according to one embodiment of the present disclosure may be preferable to further include a support yoke 170 supporting at least one of the first rack bar 151 and the second rack bar 152. The support yoke 170 is a configuration employed for preventing a gap between the first rack bar 151 or the second rack bar 152, and the pinion 160 so that there is effectiveness capable of preventing a misoperation due to abrasion of the groove formed at each of the first rack bar 151 and the second rack bar 152, or the shape of the pinion 160 corresponding to the groove, and a rattle noise due to a generation of the gap.

Figure 4:
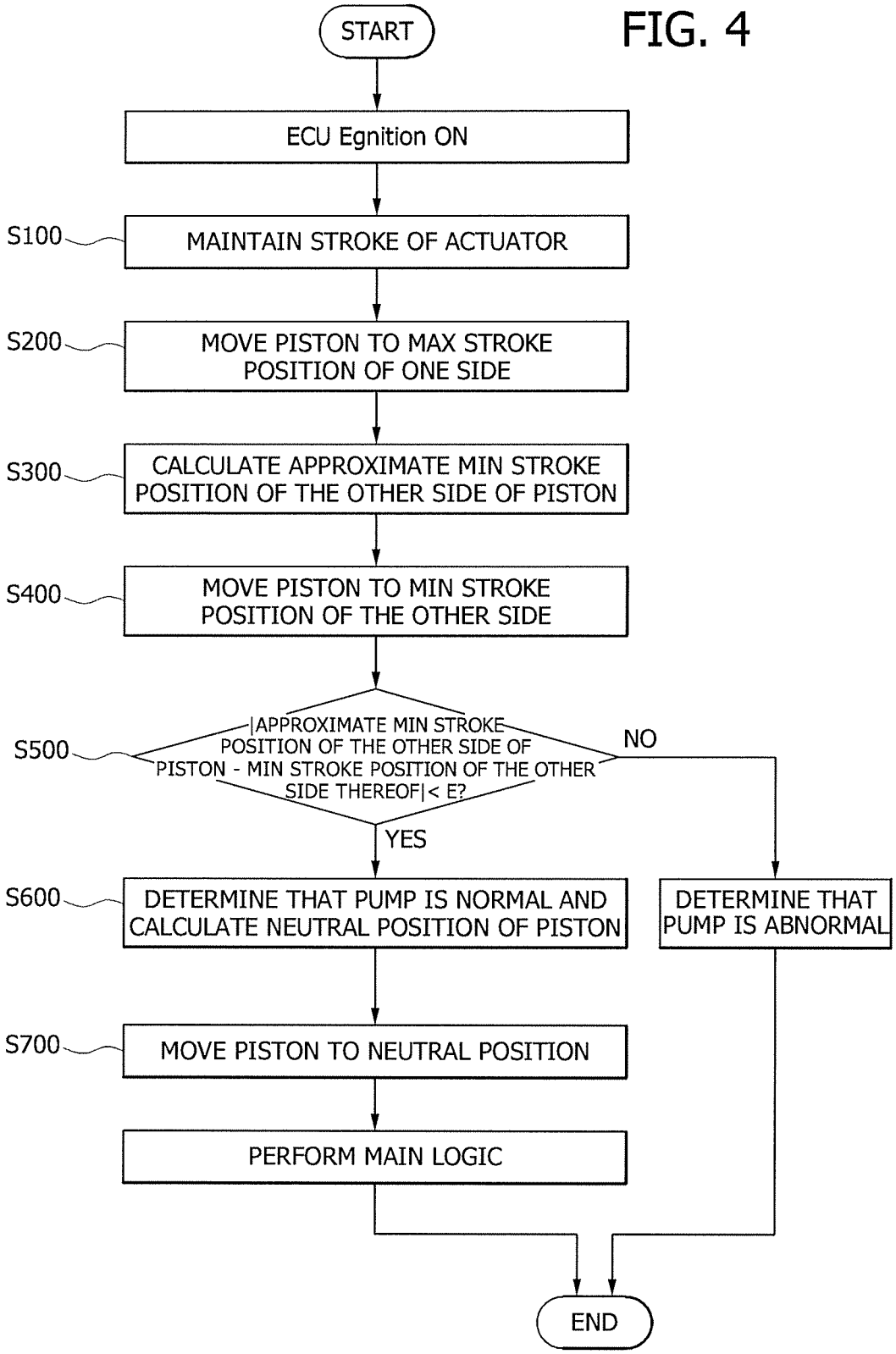
FIG. 4 is a flowchart illustrating in time series the method of setting a zero point of a bi-directional linear pump according to one embodiment of the present disclosure.
Figure 5:
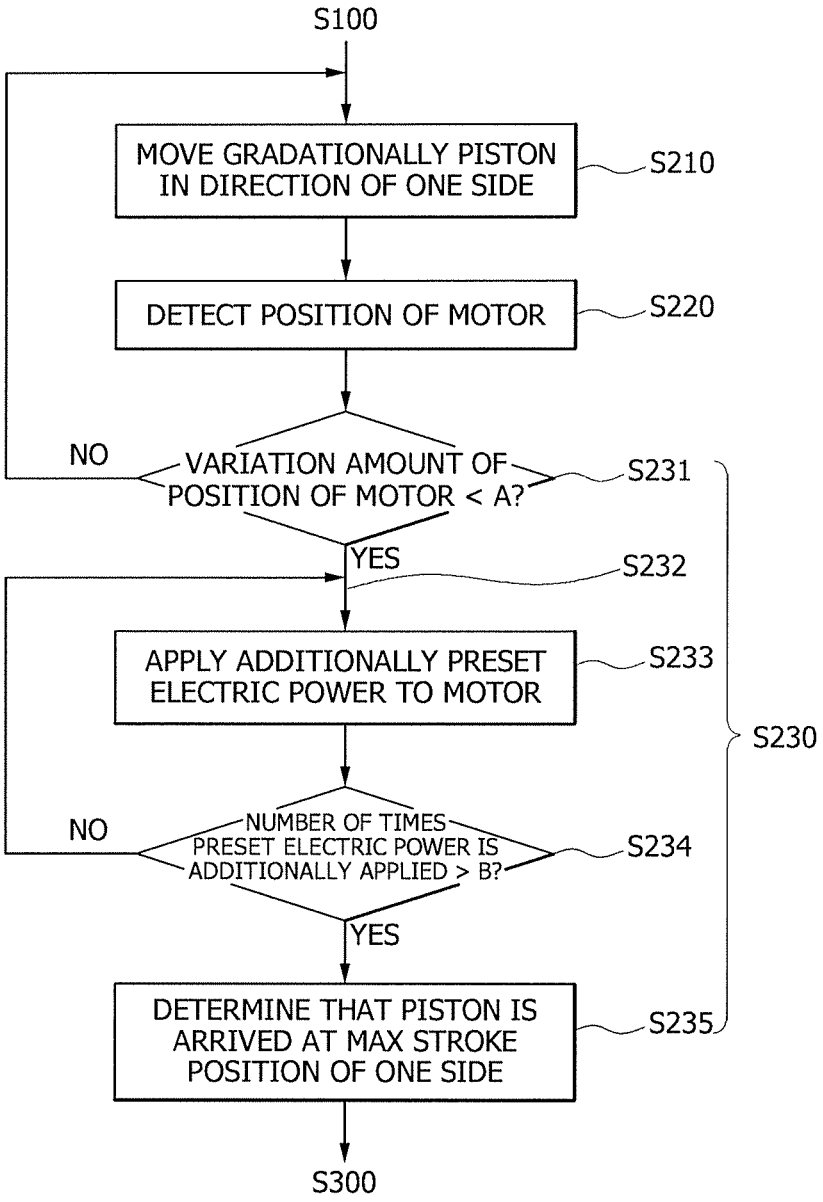
FIGS. 5 to 7 are subdivided flowcharts of some Operations of FIG. 4.
Figure 6:
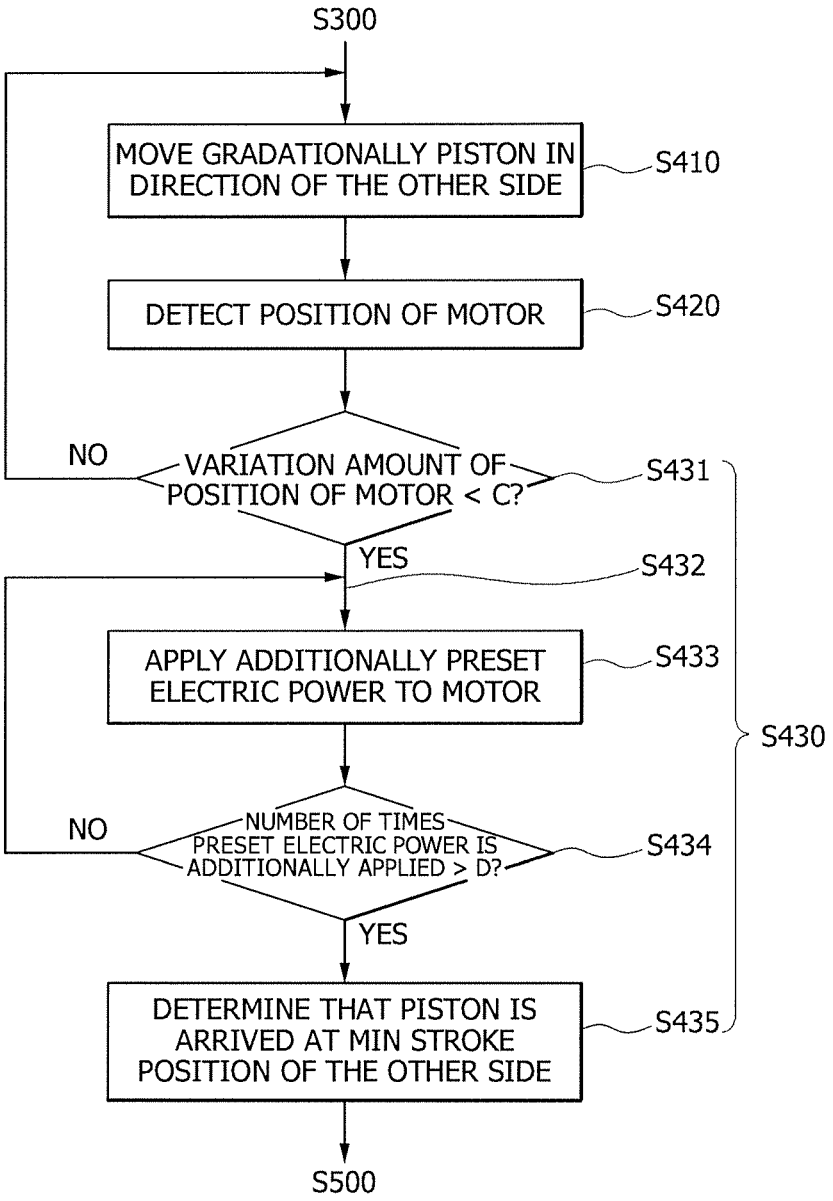
Figure 7:
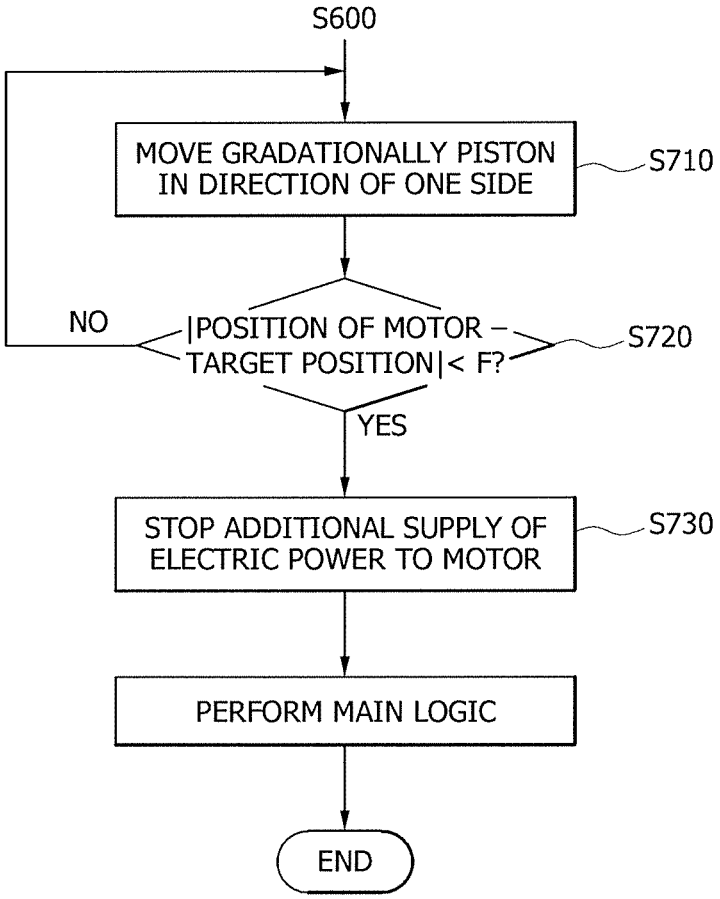

On the basis of the above description regarding the active suspension apparatus for vehicles and the pump applied thereto, a method of setting a zero point of a bi-directional linear pump for the active suspension apparatus according to one embodiment of the present disclosure will be described below with reference to FIGS. 4 to 7. FIG. 4 is a flowchart illustrating in time series a method of setting a zero point of a bi-directional linear pump according to one embodiment of the present disclosure, and FIGS. 5 to 7 are subdivided flowcharts of some Operations of FIG. 4.

The method of setting a zero point of a bi-directional linear pump for the active suspension apparatus according to one embodiment of the present disclosure relates to a method of setting a zero point of the bi-directional linear pump 100 for the active suspension apparatus supplying fluid to the actuator 200 connected to the coil spring coupled to a wheel of a vehicle, and, as shown in FIG. 4, the method roughly includes a first Operation S100 maintaining a stroke of an actuator, a second Operation S200 moving the piston 141 to a MAX Stroke position of one side thereof, a third Operation S300 calculating an approximate MIN Stroke position of the other side of the piston 141, a fourth Operation S400 moving the piston 141 to the MIN Stroke position of the other side thereof, a fifth Operation S500 comparing the approximate MIN Stroke position of the other side of the piston 141 with the MIN Stroke position of the other side thereof, a sixth Operation S600 determining whether or not the pump 100 is normal and calculating a neutral position of the piston 141, and a seventh Operation S700 moving the piston 141 to the neutral position.

The first Operation S100 is Operation in which an electronic control unit (ECU) controls at least one of a first valve 450 disposed between the actuator 200 and the pump 100, and a second valve 460 disposed between the pump 100 and the fluid reservoir 500. In particular, the ECU may be preferable to control the first valve 450 to block a flow of the fluid between the actuator 200 and the pump 100, and the second valve 460 to allow a flow of the fluid between the pump 100 and the fluid reservoir 500. Through such Operation, when the piston 141 is moved to a neutral position, a stroke of the actuator 200 may not be affected and also a movement path of the 141 may be secured.

After the first Operation S100, the second Operation S200 is performed to move the piston 141 disposed inside the pump 100 to a MAX Stroke position of one side. In particular, as shown in FIG. 5, the second Operation S200 may include a 2-1 Operation S210 moving gradationally the piston 141 in a direction of one side by a step of a predetermined increase amount by supplying a preset electric power to the motor 110 at a regular period, and thus an abrupt movement of the motor 110 may be prevented. Thereafter, a 2-2 Operation S220 detecting a position of the motor 110, which rotated for a period, and a 2-3 Operation S230 determining whether or not the piston 141 is arrived at the MAX Stroke position of one side based on the detected position of the motor 110 may be included.

In particular, the 2-3 Operation S230 includes a 2-3a Operation S231 detecting a first position of the motor 110, which rotated for a current period, and a second position of the motor 110, which rotated for a previous period, and comparing a difference between the first and second positions with a preset value A. That is, when the electric power is applied to the motor 110 at each period, the piston 141 is gradationally moved by a step of a constant increase amount in the direction of one side so that positions of the motor 110 at the current period and the previous period are different from each other. Finally, when the piston 141 has been arrived at the MAX Stroke position of one side as shown in FIG. 3, the motor 110 does not rotate any more even though the electric power is applied thereto so that the difference between the first and second positions becomes 0 or comes close to 0. Therefore, after the 2-3a Operation S231, when the difference between the first and second positions is less than the preset value A, a 2-3b Operation S232 is performed to determine that a rotation of the motor 110 stops. At this point, it may be preferable to determine the preset value A in consideration of a separation status between the pinion 160 and the rack bars 151 and 152.

When the rotation of the motor 110 stops as determining in the 2-3b Operation S232, it may be possible to determine that the piston 141 is arrived at the MAX Stroke position of one side. In addition, by considering that the motor 110 may temporarily stop due to a reason of hardware or software in a state in which the piston 141 is not arrived at the MAX Stroke position of one side, it may be preferable to perform a 2-3c Operation S232 in which the preset electric power is additionally applied to the motor 110 at a regular period after the 2-3b Operation 232, and a 2-3d Operation S234 and a 2-3e Operation S235 in which a number of times the electric power is additionally applied is counted and, when the counted number of times is compared with a predetermined number of times B and it is greater than the predetermined number of times B, that is, it is determined that no position difference of the motor 110 occurs for a predetermined time, the piston 141 is determined to have been arrived at the MAX Stroke position of one side.

Meanwhile, it may be possible to set a zero point by calculating a neutral position O of the piston 141 based on the MAX Stroke position of one side thereof calculated in the second Operation S200 and moving the piston 141 in a direction of the other side to move the piston 141 to the neutral position O. In such a case, however, due to a problem of a hardware configuration including a motor, a gear, a valve, or the like which is included in the active suspension apparatus, there may be open to a generation of a problem when the piston 141 is fixed in a state in which the piston 141 is not arrived at the MAX Stroke position. In particular, the ECU may calculate a neutral position not an actual neutral position to cause a problem of a misoperation due to a fault center point setting of the active suspension apparatus, and also the ECU cannot determine such a fail state unless a separate stroke sensor is used therein. Therefore, in the method of setting a zero point of a bi-directional linear pump for the active suspension apparatus according to one embodiment of the present disclosure, after the second Operation S200 moving the piston 141 to the MAX Stroke position of one side thereof, the third Operation S300 calculating an approximate MIN Stroke position of the other side of the piston 141, the fourth Operation S400 moving the piston 141 to the MIN Stroke position of the other side thereof, and the fifth Operation S500 comparing the approximate MIN Stroke position of the other side calculated in the third Operation S300 with the MIN Stroke position of the other side calculated in the fourth Operation S400 are performed. Through such Operations, detecting whether or not the piston 141 is fixed may be possible, and the third Operation S300 to the fifth Operation S500 will be described in detail below.

As described above, in a state in which the piston 141 is located at the MAX Stroke position of one side in the second Operation S200, the third Operation S300 is performed to calculate the approximate MIN Stroke position of the other side of the piston 141. Such an approximate MIN Stroke position of the other side of the piston 141 may be calculated based on a length of a chamber accommodating the piston 141, that is, a reciprocating-available distance thereof, and also based on a constant value derived from an experiment, a measurement, or the like.

After the third Operation S300, the fourth Operation S400 is performed to move the piston 141 located at the MAX Stroke position of one side thereof to the MIN Stroke position of the other side thereof. The fourth Operation S400, as shown in FIG. 6 in detail, may include a 4-1 Operation S410 moving gradationally the piston 141 in the direction of the other side thereof by a step of a constant increase amount by applying the preset electric power to the motor 110 at a regular period, and thus an abrupt movement of the motor 110 may be prevented. Thereafter, a 4-2

Operation S420 detecting a position of the motor 110, which rotated for the period, and a 4-3 Operation S430 determining whether or not the piston 141 is arrived at the MIN Stroke position of the other side thereof based on the detected position of the motor 110 may be included.

Specifically, the 4-3 Operation S430 includes a 4-3a Operation S431 detecting a third position of the motor 110, which rotated for a current period, and a fourth position thereof, which rotated for a previous period, to compare a difference between the third and fourth positions with a preset value C. That is, when the preset electric power is applied to the motor 110 at each period, the piston 141 is gradationally moved by a step of a constant increase amount in the direction of the other side so that positions of the motor 110 at the current period and the previous period are different from each other. Finally, when the piston 141 is arrived at the MIN Stroke position of the other side, the motor 110 does not rotate any more even though the preset electric power is applied thereto so that the difference between the third and fourth positions becomes 0 or comes close to 0. Therefore, after the 4-3a Operation S431, when the difference between the third and fourth positions is less than the preset value C, a 4-3b Operation S432 is performed to determine that a rotation of the motor 110 stops. At this point, it may be preferable to determine the preset value C in consideration of a separation status between the pinion 160 and the rack bars 151 and 152.

When the rotation of the motor 110 stops as determining in the 4-3b Operation S432, it may be possible to determine that the piston 141 is arrived at the MIN Stroke position of the other side thereof. In addition, by considering that the motor 110 may temporarily stop due to a reason of hardware or software in a state in which the piston 141 is not arrived at the MIN Stroke position of the other side thereof, it may be preferable to perform a 4-3c Operation S433 applying additionally the preset electric power to the motor 110 at a regular period after the 4-3b Operation 432, and a 4-3d Operation S434 and a 4-3e Operation S435 in which a number of times the electric power is additionally applied is counted and, when the counted number of times is compared with a predetermined number of times D and it is greater than the predetermined number of times D, that is, it is determined that no position difference of the motor 110 occurs for a predetermined time, the piston 141 is determined to have been arrived at the MIN Stroke position of the other side thereof.

After the fourth Operation S400 is performed, the fifth Operation S500 is performed to compare the approximate MIN Stroke position of the other side calculated in the third Operation S300 with the MIN Stroke position of the other side calculated in the fourth Operation S400.

Based on the comparison result in the fifth Operation S500, the sixth Operation S600 is performed to determine whether or not the pump 100 is normal. In particular, when the difference between the approximate MIN Stroke position of the other side of the piston 141 and the MIN Stroke position thereof is greater than a preset value E, it is determined that the pump 100 is fixed to be abnormal, thereby informing a user of the determination result or taking action to inactivate the active suspension system and the like. On the other hand, when the difference between the approximate MIN Stroke position of the other side of the piston 141 and the MIN Stroke position thereof is less than the preset value E, it is determined that the pump 100 is normal, and simultaneously, a neutral position of the piston 141 or a target position of the motor 110 corresponding to the neutral position of the piston 141 is calculated. Such a neutral position of the piston 141 or such a target position of the motor 110 may be calculated by a calculation or an experiment based on at least one of the MAX Stroke position of one side of the piston 141 and the MIN Stroke position of the other side thereof.

The seventh Operation S700 is performed to move the piston 141 in the direction of one side thereof, thereby moving the piston 141 to the neutral position based on the calculated neutral position of the piston 141 or the calculated target position of the motor 110. By looking at such a seventh Operation S700 in detail with reference to FIG. 7, a 7-1 Operation S710 is performed to apply the preset electric power to the motor 110 at a regular period to gradationally move the piston 141 in the direction of one side thereof, and a 7-2 Operation S720 is performed to compare a difference between a current position of the motor 110 and the calculated target position thereof with a preset value F. Thereafter, when the difference between the current position of the motor 110 and the calculated target position thereof is less than the preset value F, a 7-3 Operation S730 is performed to stop the applying of the preset electric power so that a setting of a zero point of the piston 141 is completed.

Meanwhile, by considering that the first Operation S100 to the seventh Operation S700 described above are preliminary Operations for effectively performing a main logic, these Operations may be preferable to be performed after an ignition signal of the ECU is turned on, or before a main logic for an anti-rolling control is commenced.

Although the embodiments and the accompanying drawings have been described with reference to a number of illustrative embodiments of the present disclosure, it should be understood that numerous other modifications and embodiments can be devised by those skilled in the art that will fall within the spirit and scope of the principles of this disclosure. The embodiments disclosed herein, therefore, are not to be construed as limiting the technical concept of the present invention but are merely for explanation thereof, and the range of the technical concept is not limited to these embodiments. The scope of the present invention should be construed by the appended claims, along with the full range of equivalents to which such claims are entitled.

DESCRIPTION OF REFERENCE NUMERALS

100: Pump
110: Motor
141, 142: Piston
200: Actuator
450: First Valve
460: Second Valve
500: Fluid Reservoir

What is claimed is:

1. A method of determining whether a bi-directional linear pump for an active suspension apparatus supplying fluid to an actuator connected to a coil spring coupled to a wheel of a vehicle is normal or abnormal, comprising steps of:

controlling at least one of a first valve disposed between the actuator and the pump and a second valve disposed between the pump and a fluid reservoir by means of an electronic control unit (ECU);

moving a piston disposed inside the pump to a first side of the piston to move the piston up to a MAX Stroke position of the first side;

wherein the step of moving the piston to the first side includes steps of:

periodically applying a preset electric power to a motor for a predetermined time period to gradationally move the piston in a direction of the first side;

detecting a position of the motor, which has been rotated for the predetermined time period; and determining whether or not the piston is arrived at the MAX Stroke position of the first side based on the position of the motor, wherein the step of determining whether or not the piston is arrived at the MAX Stroke position includes:

detecting a first position of the motor, which rotated for a current time period, and a second position thereof, which rotated for a previous time period, to compare a difference between the first position and the second position with a preset value A; and determining that a rotation of the motor stops when the difference between the first position and the second position is less than the preset value A;

moving the piston to a second side of the piston to move the piston up to a MIN Stroke position;

wherein the step of moving the piston to the second side includes steps of:

periodically applying a preset electric power to a motor for a predetermined time period to gradationally move the piston in a direction of the second side;

detecting a position of the motor, which has been rotated for the predetermined time period; and determining whether or not the piston is arrived at the MIN Stroke position of the second side based on the position of the motor, wherein the step of determining whether or not the piston is arrived at the MIN Stroke position includes:

detecting a third position of the motor, which rotated for a current time period, and a fourth position thereof, which rotated for a previous time period, to compare a difference between the third position and the fourth position with a preset value C; and determining that a rotation of the motor stops when the difference between the third position and the fourth position is less than the preset value C;

comparing an approximate MIN Stroke position of the second side, which is calculated based on a length of a chamber accommodating the piston with reference to the MAX Stroke position, with the MIN Stroke position thereof; and determining whether or not the pump is normal based on the comparison result.

2. The method of claim 1, wherein the step of controlling the at least one of the first valve and the second valve enables the ECU to control the first valve to block a flow of the fluid between the actuator and the pump, and to control the second valve to allow a flow of the fluid between the pump and the fluid reservoir.

3. The method of claim 1, wherein the step of determining whether or not the piston is arrived at the MAX Stroke position further includes steps of:

applying, after the step of determining that the rotation of the motor stops, additionally the preset electric power to the motor at a regular period;

comparing a number of times the preset electric power is additionally applied with a predetermined number of times B; and determining that the piston is arrived at the MAX Stroke position of the first side when the number of times the preset electric power is additionally applied is equal to or greater than the predetermined number of times B as the comparison result of the step of comparing the number of times the preset electric power is additionally applied with the predetermined number of times B.

4. The method of claim 1, wherein the step of determining whether or not the piston is arrived at the MIN Stroke position further includes steps of:

applying, after the step of determining that the rotation of the motor stops, additionally the preset electric power to the motor at a regular period;

comparing a number of times the preset electrical power is additionally applied with a predetermined number of times D; and determining that the piston is arrived at the MIN Stroke position of the second side when the number of times the preset electrical power is additionally applied is equal to or greater than the predetermined number of times D as the comparison result of the step of comparing the number of times the preset electrical power is additionally applied with the predetermined number of times D.

5. The method of claim 1, wherein the step of comparing includes comparing a difference between the approximate MIN Stroke position of the second side of the piston and the MIN Stroke position thereof with a preset value E.

6. The method of claim 5, the step of determining whether or not the pump is normal includes determining that the pump is normal when the difference between the approximate MIN Stroke position of the second side of the piston and the MIN Stroke position thereof is less than the preset value E.

7. The method of claim 1, wherein, when the pump is determined to be normal in the step of determining whether or not the pump is normal, at least one of a neutral position of the piston and a target position of the motor corresponding to the neutral position of the piston is determined based on at least one of the MAX Stroke position of the first side of the piston and the MIN Stroke position of the second side thereof.

8. The method of claim 7, further comprising a step of:

driving the motor in the direction of the first side to move the piston to the neutral position, when the pump is determined to be normal in the step of determining whether or not the pump is normal.

9. The method of claim 8, the step of driving the motor includes:

applying a preset electric power to the motor at a regular period to gradationally move the piston;

comparing a position of the motor with the target position thereof; and stopping the applying of the preset electric power when a difference between the position of the motor and the target position thereof is less than a preset value F.

* * * * *